US008578530B2

(12) United States Patent
Patwardhan

(10) Patent No.: US 8,578,530 B2
(45) Date of Patent: Nov. 12, 2013

(54) SLIDING BACK FOR FOULER BED

(75) Inventor: Bhaskar Vitthal Patwardhan, Maharashtra (IN)

(73) Assignee: Precision Automation and Robotics India Ltd., Maharashtra (IN)

( * ) Notice: Subject to any disclaimer, the term of this patent is extended or adjusted under 35 U.S.C. 154(b) by 771 days.

(21) Appl. No.: 12/668,393

(22) PCT Filed: Jun. 26, 2008

(86) PCT No.: PCT/IN2008/000409
§ 371 (c)(1),
(2), (4) Date: Apr. 22, 2010

(87) PCT Pub. No.: WO2009/057132
PCT Pub. Date: May 7, 2009

(65) Prior Publication Data
US 2010/0199429 A1 Aug. 12, 2010

(51) Int. Cl.
*A47B 13/00* (2006.01)

(52) U.S. Cl.
USPC ..... 5/604; 5/614; 5/613; 5/612; 5/81.1 R; 5/83.1; 5/88.1

(58) Field of Classification Search
USPC ..... 5/614, 604, 613, 612, 606, 81.1 R, 83.1, 5/88.1, 89.1
See application file for complete search history.

(56) References Cited

U.S. PATENT DOCUMENTS 43,900 A * 8/1864 Crosby ..... 5/600
520,576 A * 5/1894 Scearce ..... 5/83.1
1,273,599 A * 7/1918 Floyd ..... 5/88.1
3,215,469 A * 11/1965 Wamsley ..... 297/344.18
3,383,717 A * 5/1968 Underwood ..... 5/612
3,405,931 A * 10/1968 Anderson ..... 5/612
3,438,067 A * 4/1969 Saunders ..... 5/612
4,109,329 A * 8/1978 Tupper ..... 5/607
4,620,333 A * 11/1986 Ritter ..... 5/695
4,800,599 A * 1/1989 Korchinski et al. ..... 5/618
4,833,742 A * 5/1989 Kuhn ..... 5/604
4,843,665 A 7/1989 Cockel et al.

(Continued)

FOREIGN PATENT DOCUMENTS

WO WO 2007051228 5/2007

OTHER PUBLICATIONS

International Search Report for International Application No. PCT/IN2008/000409, completed Jun. 5, 2009.

*Primary Examiner* — Robert G. Santos
*Assistant Examiner* — David E Sosnowski
(74) *Attorney, Agent, or Firm* — Rankin, Hill & Clark LLP

(57) ABSTRACT

A bed and chair with commode for a patient is disclosed. The bed and chair with commode includes a rectangular main frame, which stands on at least four legs, four frames fitted on the main frame, patient's body over it when patient is lifted up off the bed, side guards being fixed on both sides of main frame for supporting the straps or nets over it and for avoiding the patient from falling down a lifting means for lifting the body of patient over the straps or nets, and a commode pan or pot being fitted under the middle frame with the help of hinge and linkage arrangement. The sliding back of the bed moves upwards and downwards by a mechanism when the back support frame is raised to chair position or lowered to bed position.

11 Claims, 10 Drawing Sheets

(56) References Cited

U.S. PATENT DOCUMENTS

| | | | | | |
|---|---|---|---|---|---|
| 5,161,267 | A | * | 11/1992 | Smith | 5/88.1 |
| 5,235,712 | A | * | 8/1993 | Smith | 5/84.1 |
| 5,265,296 | A | * | 11/1993 | Abbas et al. | 5/612 |
| 5,500,964 | A | * | 3/1996 | Bergersen | 5/607 |
| 5,539,941 | A | * | 7/1996 | Fuller | 5/85.1 |
| 5,640,729 | A | * | 6/1997 | Marino | 5/607 |
| 5,659,905 | A | * | 8/1997 | Palmer et al. | 5/88.1 |
| 5,842,237 | A | * | 12/1998 | Hargest et al. | 4/449 |
| 5,926,875 | A | * | 7/1999 | Okamoto et al. | 5/605 |
| 5,937,456 | A | * | 8/1999 | Norris | 5/88.1 |
| 5,996,144 | A | * | 12/1999 | Hodgetts | 5/81.1 R |
| 6,802,093 | B1 | * | 10/2004 | Pope-Brown | 5/604 |
| 6,880,186 | B2 | * | 4/2005 | Johansson | 5/81.1 R |
| 7,028,355 | B2 | * | 4/2006 | Koga | 5/606 |
| 7,140,054 | B2 | * | 11/2006 | Charles | 5/606 |
| 7,234,178 | B2 | * | 6/2007 | Qi | 5/604 |
| 7,467,426 | B1 | * | 12/2008 | Jarmon et al. | 5/191 |
| 7,562,403 | B2 | * | 7/2009 | Wei et al. | 5/81.1 R |
| 7,568,240 | B2 | * | 8/2009 | Palay et al. | 5/81.1 R |
| 7,653,953 | B2 | * | 2/2010 | Lopez-Sansalvador | 5/607 |
| 8,209,800 | B2 | * | 7/2012 | Shih | 5/614 |
| 2003/0000016 | A1 | * | 1/2003 | Zenczykowski | 5/600 |
| 2009/0265854 | A1 | * | 10/2009 | Pagden | 5/606 |

* cited by examiner

SLIDING BACK FOR FOULER BED

FIELD OF THE INVENTION

This invention relates to a multipurpose bed for patients. More particularly it relates to a bed and chair with commode for a patient that enables to lift the patient off the bed.

BACKGROUND

Lifting and shifting of a disabled/bedridden person has always been difficult, risky and problematic. This lifting and shifting is dangerous and painful for the disabled person if done by the untrained person. The patients are scared of this procedure, as there is a danger of slipping and falling and getting injured.

This lifting and shifting is strenuous for the nurse. When he/she is trying to lift the patient, he/she has to bend over the patient to lift him. This posture in the long run gives the nurses a back pain and can turn into permanent back problems. A lot of medical literature is available on back problems of nurses as it is very common in nurses.

A disabled person mainly needs to be shifted from a bed to change the bed or bed sheet. The person also needs to be lifted when putting a bed pan under him. This lifting and shifting is painful and dangerous for the disabled/bedridden person. A patient gets bed sores and skin troubles due to contact with a bed as some portions of skin do not get any air which causes infections and proves fatal on most occasions.

Many lifting and shifting apparatuses are available in the market. All these apparatuses are expensive and unpractical at home as it takes a lot of space and a lot of training for the user. In hospitals, some help is available, but at home one is helpless and finds lifting and shifting very difficult.

It has been observed that it is very difficult to nurse bedridden persons, the main difficulties are:

i. lifting the person up for airing for long time;
ii. lifting the person up and off the bed for change of bed or bed sheet;
iii. lifting the person for putting bed pan under him; and
iv. making the person sit upright in a chair position.

In beds available in the market, only the back frame goes in the upright position. The leg support frames do not go down. Also they do not have commode facility.

It is a common fact that all the patients on fouler (back straitening) bed slide down with the operation of the backrest. They have to be pulled up every day and that is strenuous for nurse or family members and painful for the patient. This sliding forward of patient happens because as the back is strained the patient is pushed forward as there is no sliding movement between the patient and the back frame.

In the available equipment there is no arrangement to stop this pushing. The patient is pushed forward and so slides towards his feet. As a result he has to be pulled up when the back of the bed goes into bed position as it does not pull the patient up but goes does down to bed position so the patient remains in the pushed forward position. In the available equipment nothing is available to solve this problem.

Hence there is a need of an improved bed or lifting apparatus for a patient that has a sliding back which will address and overcome all the problems of the bed or lifting & shifting apparatus of the prior art.

The primary object of the present invention is to provide a bed or lifting apparatus for a patient which will address and overcome all the problems of the bed or lifting & shifting apparatus of the prior art.

Another object of the present invention is to provide a bed or lifting apparatus for a patient, which enables the patient to be lifted off the bed for airing the patient and for change of bed.

Yet another object of the present invention is to provide a bed or lifting apparatus for a patient which can be converted into chair.

Yet another object of the present invention is to provide a bed or lifting apparatus for a patient which has the built in commode.

Yet another object of the present invention is to eliminate shifting the patient from chair to bed and vice versa as the bed itself turns into chair.

To overcome this problem a need was felt to invent some mechanism, which will

1. Stop pushing the patient forward (towards legs)
2. Will save the energy of nurse and make their life easy
3. The patient will not have to go through the painful procedure.

SUMMARY OF THE INVENTION

Embodiments are disclosed herein as illustrative examples. In one embodiment, there is provided bed cum chair with commode for a patient comprises a rectangular main frame which stands on at least four legs and four frames fitted on the main frame, out of the four frames, an uppermost frame and two lower frames are movably fitted on the main frame and a middle frame is permanently fixed to the main frame. The upper movable frame supports an associated patient's upper body and head portion, and the two lower movable frames support the leg portion of the patient, the middle fixed frame supports the hip portion of the patient, and the lowermost frame is fitted on other lower frame. The bed further includes at least seven straps or nets across the bed width for accommodating the patient's body over it when patient is lifted up off the bed. At one end, the straps or nets are fixed to the main frame and are connected to the arms of a turnable bar at other end. The bar is connected between two legs supporting the longer side of the main frame, and the arms are capable of turning around. The bed also includes side guards that are fixed on both sides of main frame for supporting the straps or nets over it and for preventing the patient from falling down and a lifting means for lifting the body of patient over the straps or nets. When a patient is to be lifted up off the bed, the lifting means lifts a central arm of the turnable bar so that the bar with its arm turned downwards pulls the straps or nets over the side guards and lifts the patient off the bed.

Additionally, the bed includes a commode pan or pot being fitted under the middle frame with the help of a hinge and a linkage arrangement, the position of the commode is controlled by the linkage arrangement. The commode is provided with cushion which is placed between commode and middle frame.

According to another embodiment of the invention, the upper, middle and lower frames are associated with turning jacks\threaded rods for controlling the movement of the frames. The upper frame can be tilted at different angles ranging from sleeping position to a sitting upright position with the use of turning jack\threaded rods. The lower frame can be tilted at different angles ranging from sleeping position with legs straight to a sitting position in which the legs are at right angles with the use of turning jack\threaded rods. The lowermost frame folds into two pieces. The frame (d) which is on top of the lowermost frame folds into three pieces.

According to another embodiment of the invention, the number of arms on turnable bar is equal to number of straps or net.

According to yet another embodiment of the invention, the lifting means may be hydro mechanically operated. The hydro mechanical arrangement consists of hydraulic telescope with handle.

According to another embodiment of the invention, lifting means may be electrically operated with electric motor or hydraulically operated with hydraulic pump.

According to another embodiment of the invention, lifting means may be pneumatically operated with pneumatic pressure.

BRIEF DESCRIPTION OF THE DRAWINGS

FIG. 2(*b*) illustrates the bed cum chair with commode with uppermost frame in upright position;

FIG. 2(*c*) illustrates the bed cum chair with commode with uppermost and lowermost frame in horizontal position and frame (d) on the lowermost frame in a folded position for knee support;

FIG. 3(*b*) illustrates the bed cum chair with commode with arms of the turnable bar in turned around position and the straps/nets pulled over side guards for lifting a patient up;

FIG. 4(*b*) illustrates the bed cum chair with commode where the straps/nets are pulled over the side guards and a person is lifted up off the bed;

FIG. 6(*b*) illustrates the bed cum chair with commode with a person in the rest position and the straps ties to the pipes are pulled to lift the person off the bed;

DETAILED DESCRIPTION OF THE INVENTION

The above, and the other objects, features & advantages of invention will become apparent from following description read in conjunction with the accompanying drawings.

Figure 1:
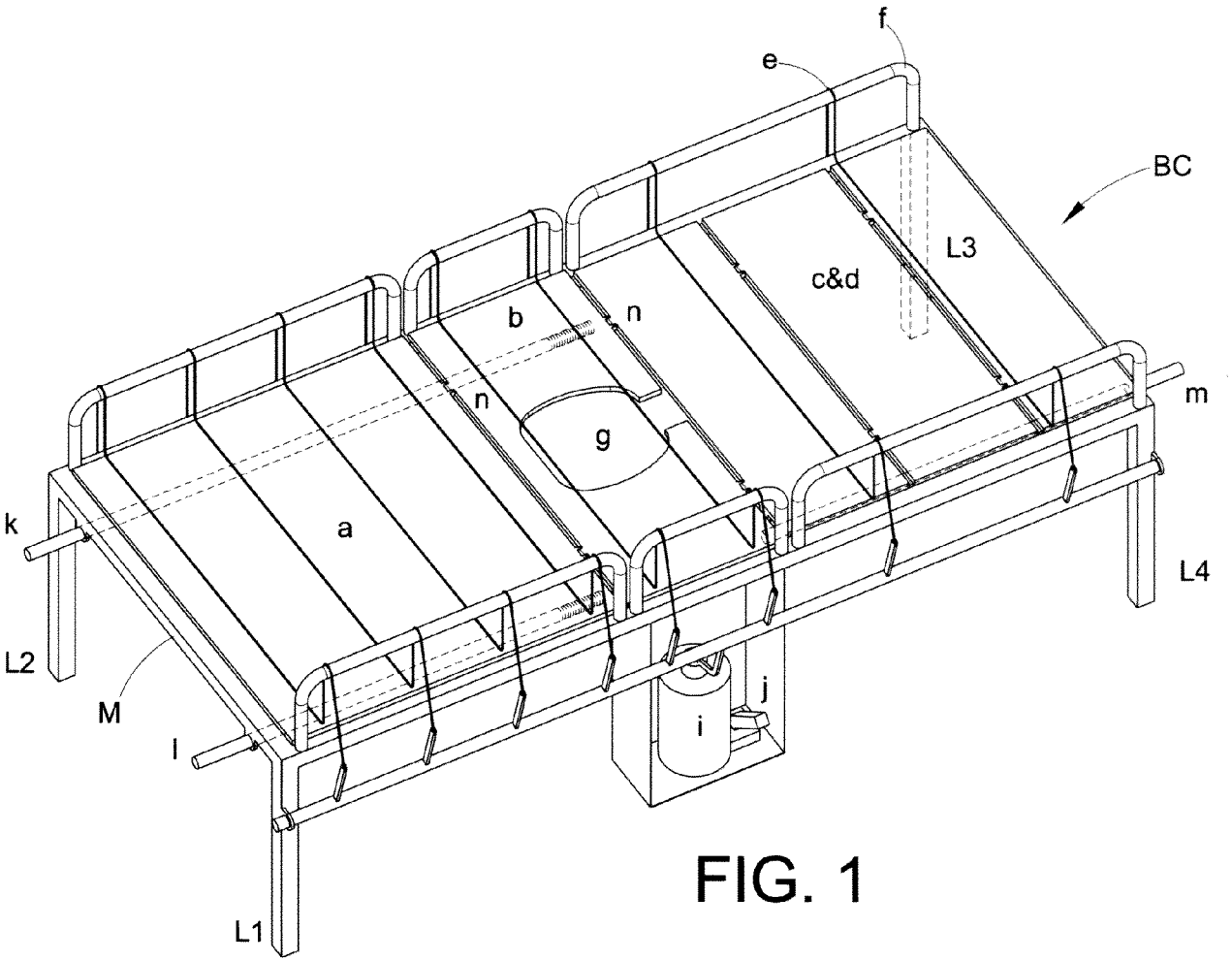
FIG. 1 illustrates the bed cum chair with commode for a patient according to the present invention.

Referring to FIG. 1, a bed and chair with commode (BC) according to present invention comprises a rectangular main frame (M), four frames (a, b, c, d) being fitted on main frame, at least seven straps or nets (e) across the bed width for accommodating the patient's body over it when patient is lifted up off the bed, side guards (f) being fixed on both sides of main frame (M) for supporting the straps or nets (e) over it and for avoiding the patient from falling down; lifting means (i, j) for lifting the body of patient over the straps or nets (e), and commode pan or pot (g).

The bed (BC) of the present invention comprises main frame (M) of the rectangular shape. This frame stands on four legs (L1, L2, L3, L4). There may be more number of legs than four.

Figure 2A:
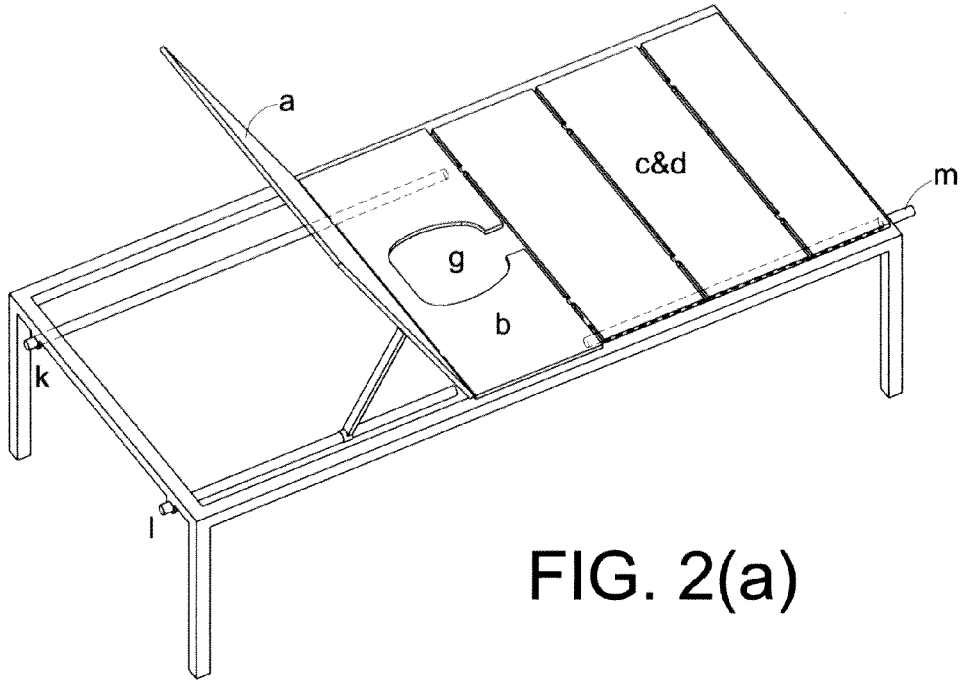
FIG. 2(*a*) illustrates the bed cum chair with commode with the uppermost frame in an upright position.
Figure 2B:
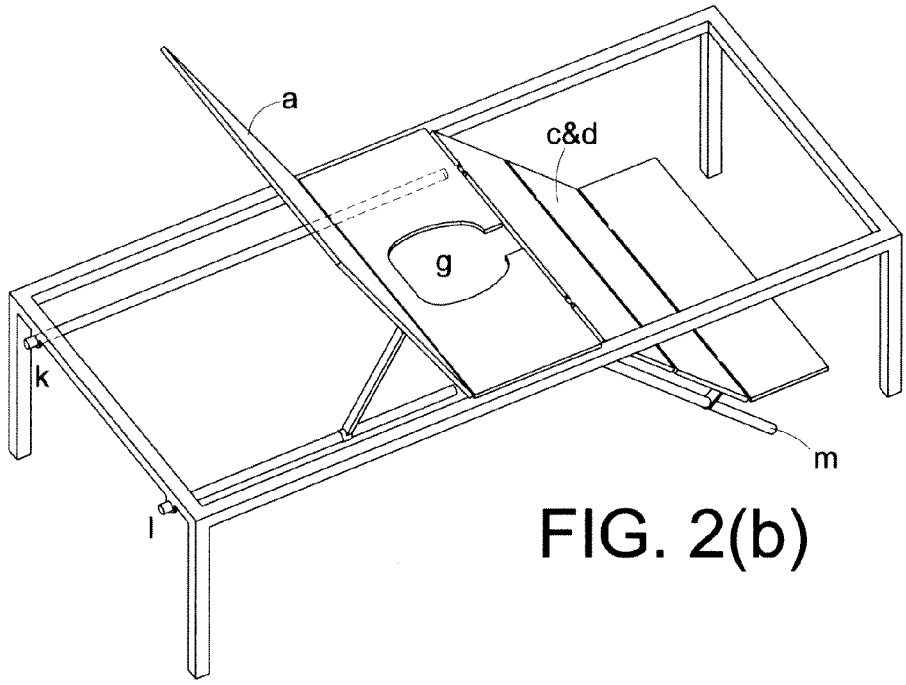
Figure 2C:
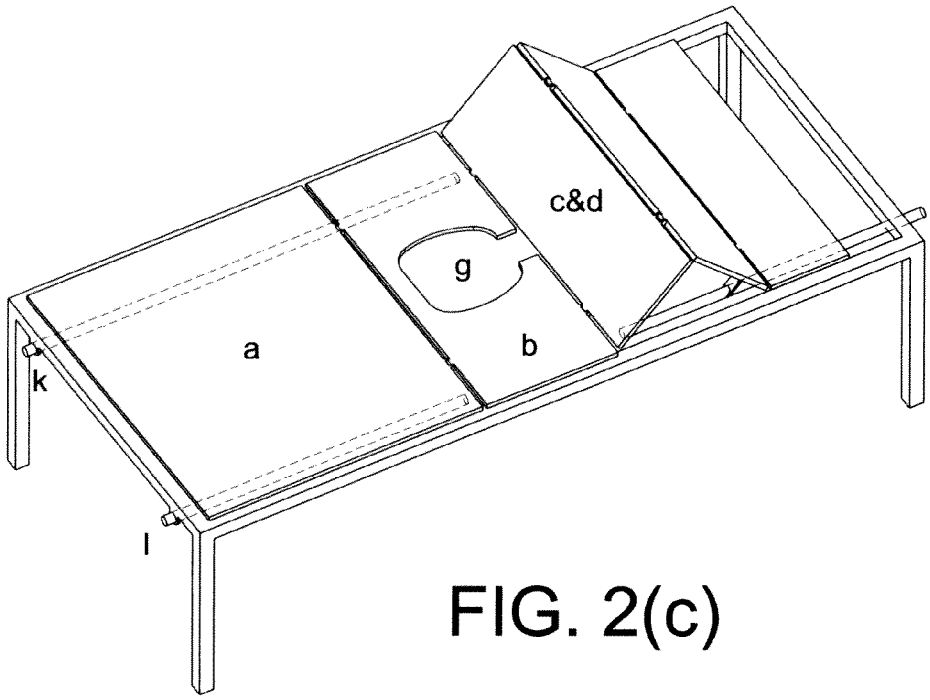

Out of four frames (a, b, c, d) upper frame (a) and lower frames (c, d) are movably fitted on the main frame (M) and middle frame (b) is stationary and is attached to the main frame (M). The frames (a, c, d) are moved by using turning jacks\threaded rods (l, k, m) respectively. Frame (a) supports the upper body and head portion of the patient. Frame (a) can be adjusted to a position at different angles ranging from sleeping position to a sitting upright position. This can be done by turning threaded rod (L). This can also be adjusted to a head low position using the same threaded rod. FIG. 2(*a*) shows the frame (a) in upright sitting position. The lower frame (c) can be adjusted to a position at different angles—ranging from sleeping position with legs straight to a sitting position in which the legs are at right angles. This can be done with use of threaded rod (k). This is shown in FIG. 2(*b*). Frame (d) is fitted on frame (c), but is independent for its own function. Frame (d) folds into 3 pieces, lifting the central portion by folding. This helps to support the knee joint of the patient. This frame can be folded by using threaded rod (m). This is shown in FIG. 2(*c*). All these frames (a, b, c, d) can be adjusted to different positions, independently. This means the change of position of any frame does not affect or change the position of other frame.

As mentioned earlier, the bed (BC) of the present invention also comprises at least seven straps/nets (e). These straps/nets (e) are provided across the bed width for accommodating the patient's body over it when patient is lifted up off the bed. These straps/nets (e) are on the bed below the patient i.e. under the patient's body. These straps or nets (e) at one end fixed to the main frame (M) and at other end connected to the arms of a turnable bar (h). This bar is connected between any of the two legs supporting the longer side of the main frame i.e. between L1 and L4 or between L2 and L3 depending on which side the straps/nets (e) connected to the main frame (M). This bar with arms (h) is capable of being turned around. The number of arms on turnable bar (h) is equal to number of straps or net (e). The movement of the bar (h) is done by the lifting means (i, j). The lifting means as shown in FIG. 1 consists of hydraulic telescope (i) and handle (j).

Figure 3A:
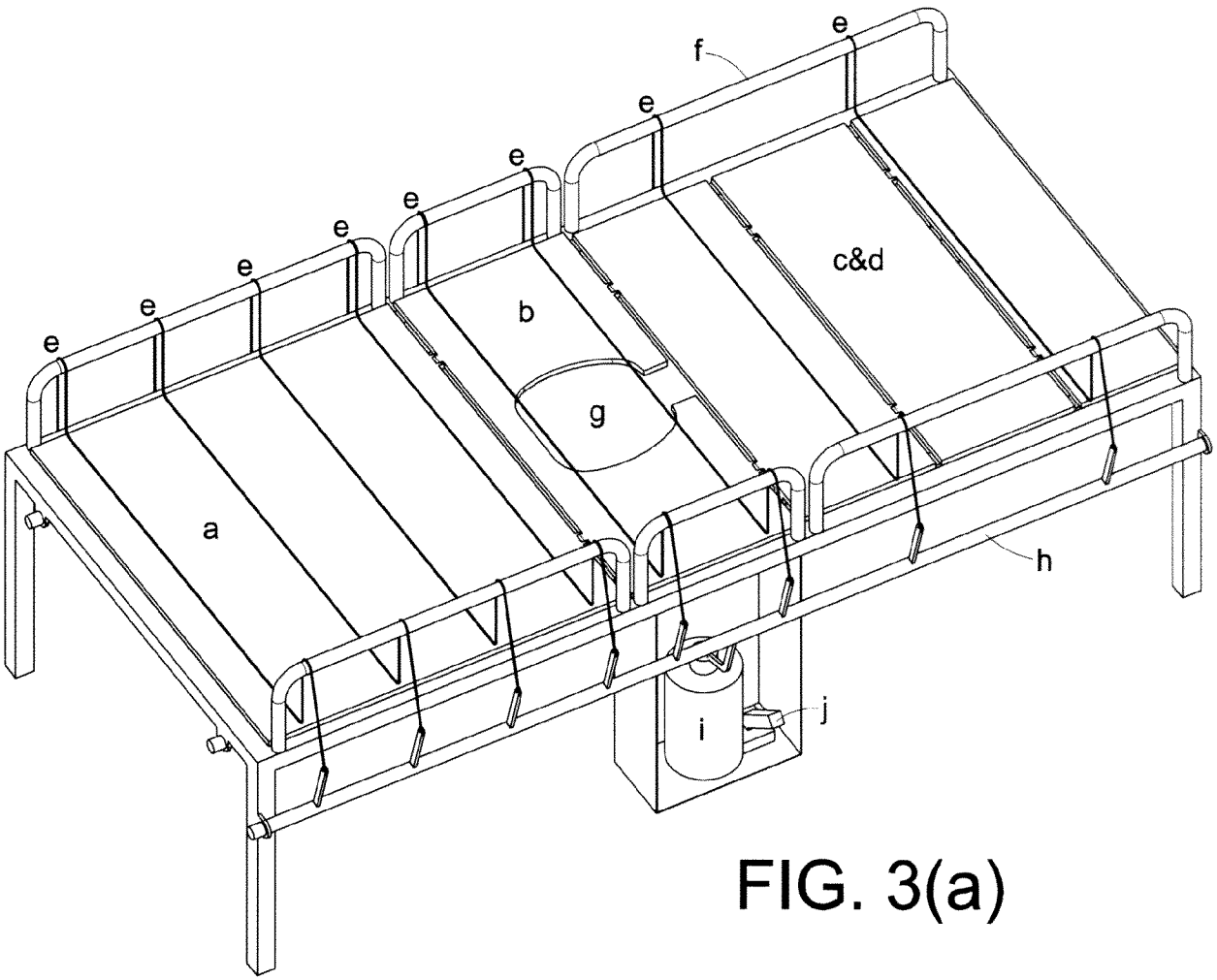
FIG. 3(*a*) illustrates the bed cum chair with commode with arms of the turnable bar in an upright position.
Figure 3B:
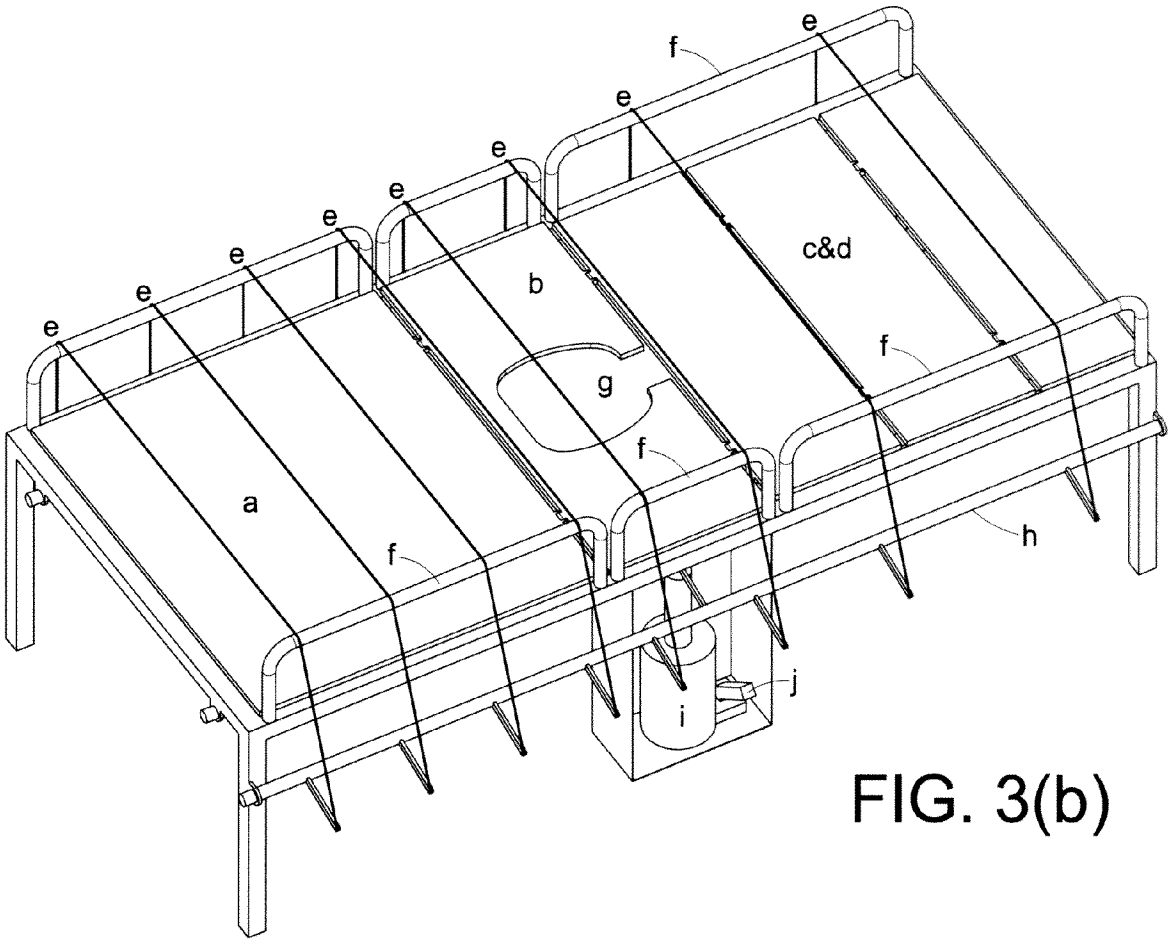
Figure 4A:
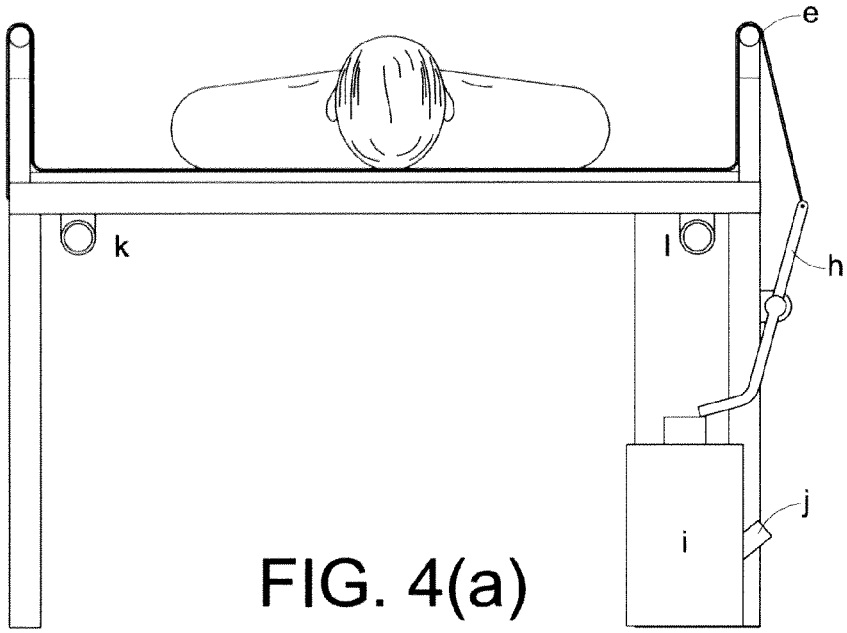
FIG. 4(*a*) illustrates the bed cum chair with commode where a person is in rest position, the arms are pointing up, and the hydraulic telescope is free.
Figure 4B:
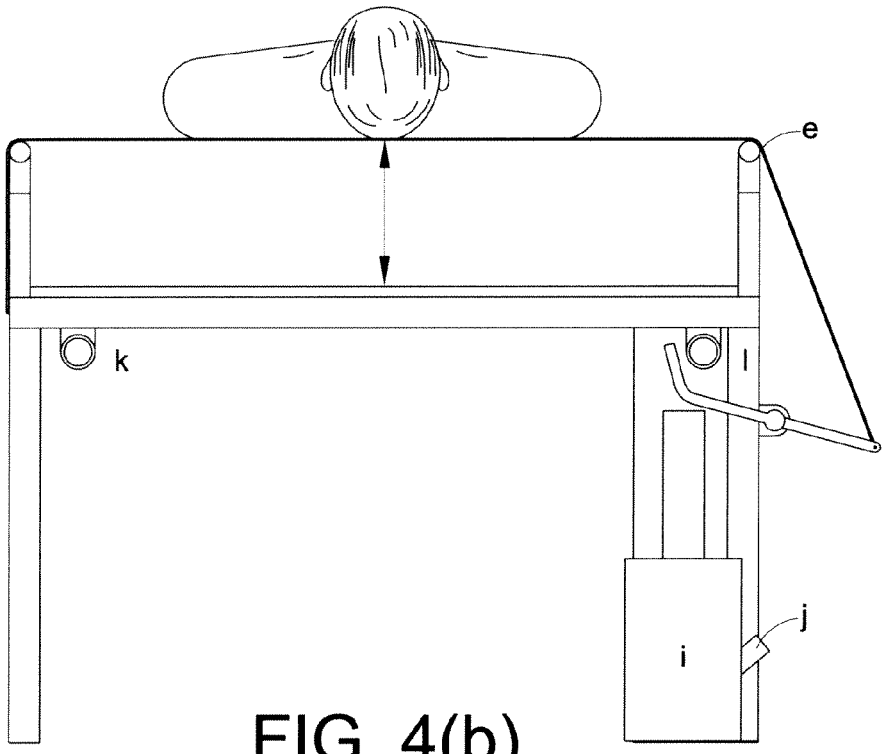

As shown in FIGS. 3(*a*) and 4(*a*), at rest position of the person, the arms are pointing up and the hydraulic telescope (i) is free. When one wants to lift a patient off the bed, he/she has to pump the hydraulic telescope (i). The telescope (i) extends in height, lifting central arm of the bar (h) upwards. This is shown in FIG. 3(*b*). The bar turns around and the arms of the bar are turned downwards. This in effect pulls the straps/nets (e) over the side guards (f) and the straps/nets (e) in effect lift the person off the bed for the purpose of airing and changing bed. This particular situation is shown in FIGS. 3(*b*) and 4(*b*).

Figure 6A:
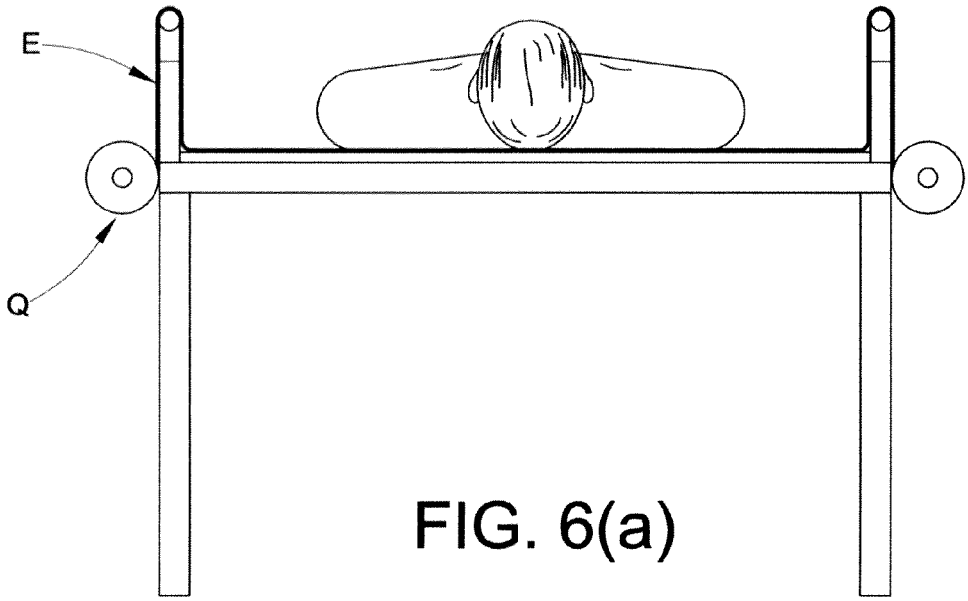
FIG. 6(*a*) illustrates the bed cum chair with commode with a person in the rest position and the straps are tied to pipes.
Figure 6B:
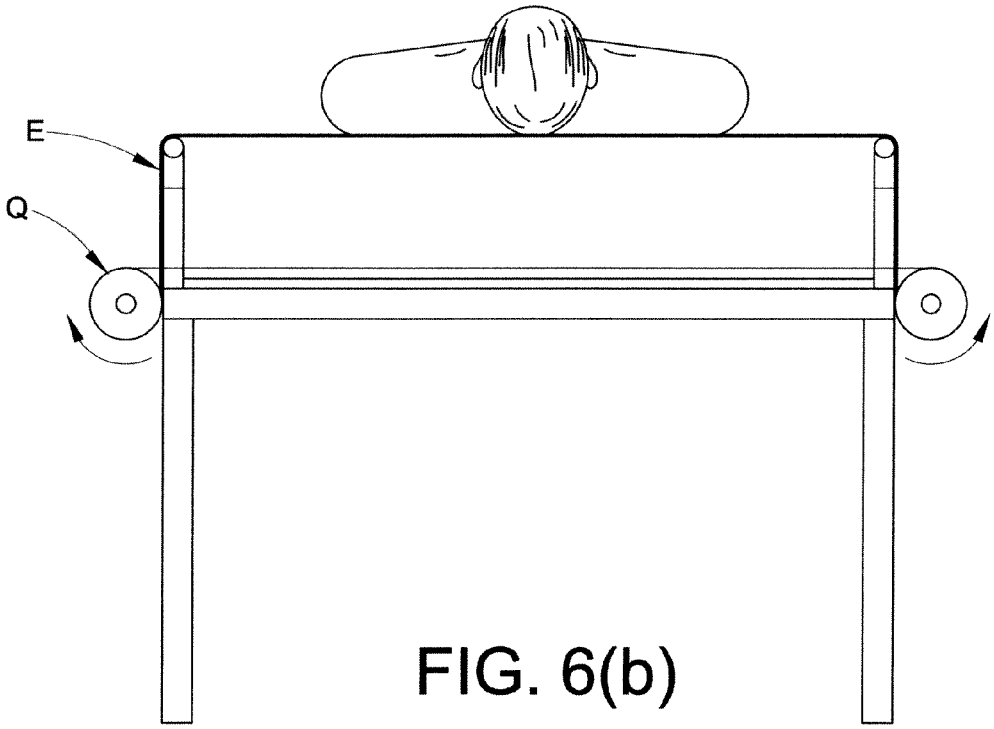

One more mechanism has been developed to pull the straps so that the patient is lifted off the bed. As illustrated in FIGS. 6(*a*) and 6(*b*), two round pipes (Q) by the side of the bed (parallel to the bed) are attached to main frame in such a way that they can be turned around. FIG. 6(*a*) displays that the straps (E) are positioned below the body of the patient and are attached to the pipes (Q) in such a way that when the pipes are turned around, the straps get wound around the pipes and pulled. FIG. 6(*b*) illustrates that when the pipes (Q) are turned around; the straps (E) are pulled over the side guards (F). As a result, the patient is lifted off the bed.

Figure 5A:
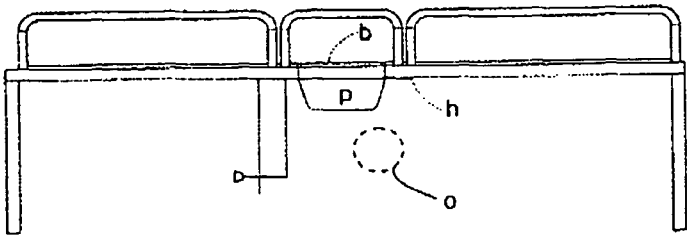
FIG. 5(*a*), (*b*), and (*c*) illustrate the bed cum chair with commode with different operating conditions of the commode.
Figure 5B:
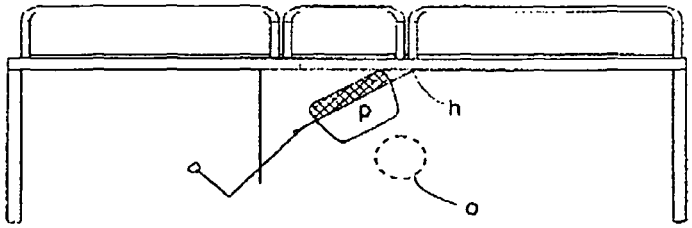
Figure 5C:
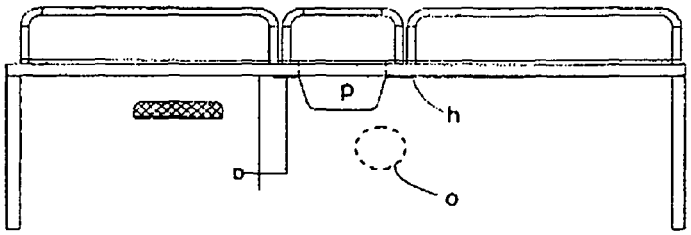

Also, commode pan or pot (g) is provided under the middle frame (b) with the help of hinge (n) and linkage (o). The position of commode (g) is controlled by linkage (o). The commode is provided with cushion (p) which is placed between commode (g) and middle frame (b). When linkage (o) is pulled back, the pan or pot is lowered from the bed from linkage side. The pot (g) is lowered along with cushion padding (p). The cushion padding can be separated from the pan/pot, when the pan/pot is to be used. By pushing the control linkage (o), the pan/pot (g) gets shifted back to its position and is now ready for use. Different operating conditions and positions of the commode are shown in FIGS. 5(*a*) to 5(*c*).

Figure 7:
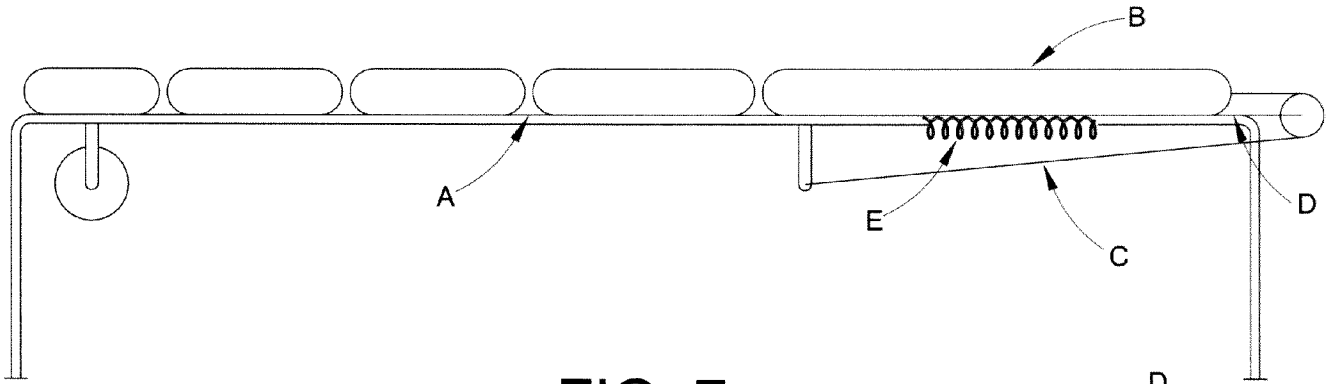
FIG. 7 illustrates the bed cum chair with commode for a patient with its back in almost a bed position with the newly sliding back fitted to it and at its original position.

FIG. 7 shows a sliding back frame (B) assembled on main frame (A) in such a way that it can slide up and down freely. The sliding back frame (B) is pulled up by cable (C) and pulled down by pulling spring (E). One end of cable is fitted to sliding back rest frame (B) and the other to main frame (A). One end of pulling spring is fitted to sliding back frame (B) and other to main frame (A).

Figure 8:
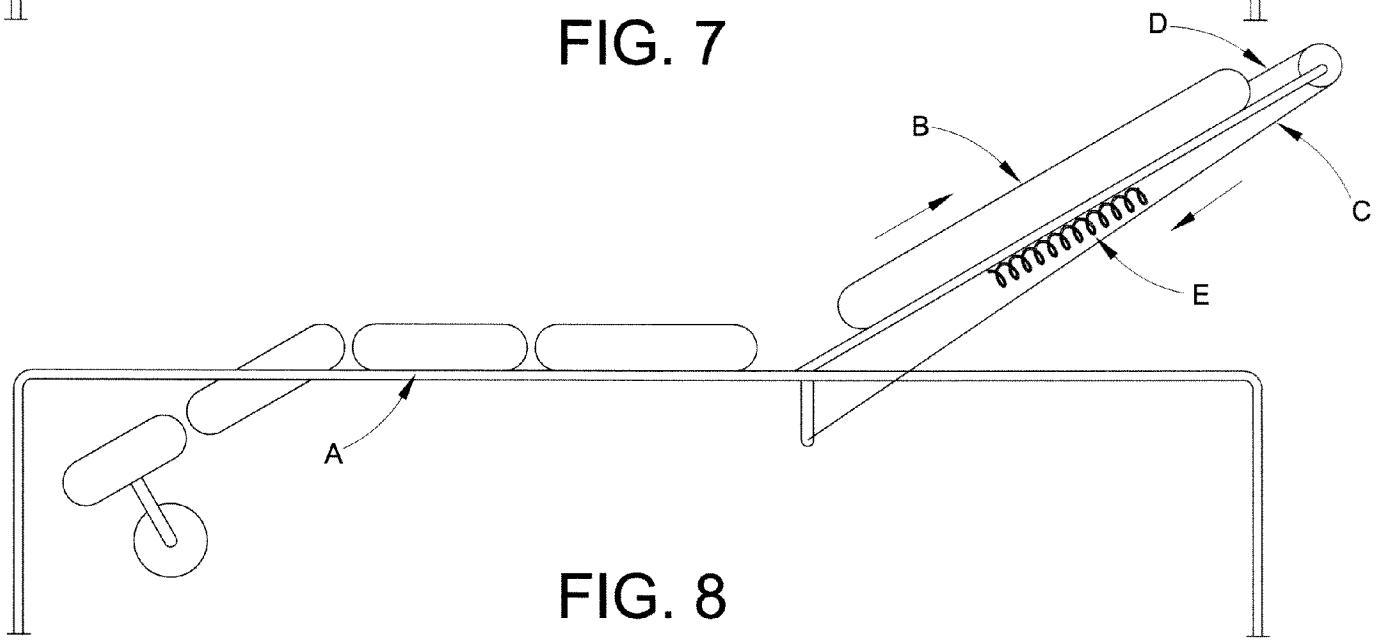
FIG. 8 illustrates the bed cum chair with commode for a patient with its back in an easy chair position with the newly sliding back fitted to it and slightly pulled up from its original position.

As shown in FIG. 8, as the back main frame (D) of a hospital bed starts going up to become vertical, the cable (C) pulls the sliding back support frame (B) upwards. As the upper body of patient is resting on the sliding back support frame, the upper body is also pulled up with the sliding back support frame. Thus, the patient is not pushed forward when the back of the hospital bed is straightened.

Figure 9:
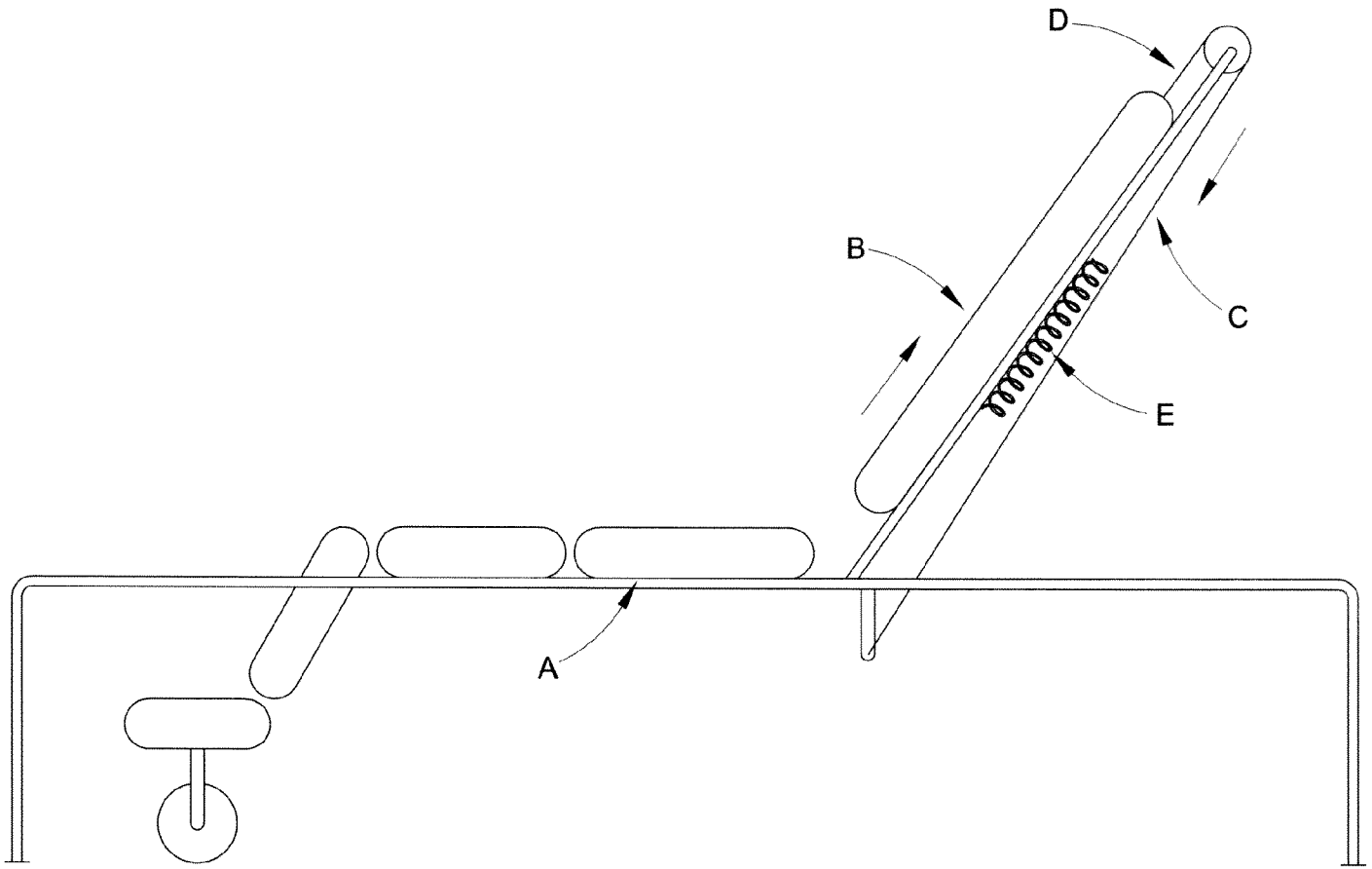
FIG. 9 illustrates the bed cum chair with commode for a patient with its back almost in a chair position with the newly sliding back fitted to it and completely pulled up so as to maintain the position of the patient on the bed.

FIG. 9 illustrates how as the back main frame (D) becomes almost straight, the cable (C) pulls the sliding back support frame (B) to fully upward position.

As the upper body of patient is resting on the sliding back support frame the upper body is also pulled up with the sliding back support frame. Thus the patient is not pushed forward when the back of the hospital bed is straightened. When the main back frame (D) is lowered to become a bed position the cable (C) slackens and the pulling spring (E) pulls the sliding back support frame (B) to its original position.

In accordance with one embodiment of the present invention, the lifting means may be operated mechanically, electrically, hydraulically and/or pneumatically. It may be operated electrically with the help of electric motor of hydraulically with the help of hydraulic pump or pneumatically with pneumatic pressure and so may be the operations of the commode.

The frames and other components of the bed can be manufactured using metals like aluminum, stainless steel, copper, brass or its alloys. All the parts may be made from materials like rubber, plastic, nylon, Teflon, fiber or other synthetic material to reduce the weight of the bed. The bed of the present invention can be manufactured in various sizes suitable for different sizes of persons/patients.

One advantage of the newly invented sliding back is that the patient is prevented from being pushed forward every time the back of the bed is moved in an upright position. Thus, the patient maintains his position on the bed and does not have to be pulled up every time. This saves a lot of trouble for the nurse/family members and a lot of pain for the patient.

The sliding back according to the present application prevents the patient from being pushed forward every time the back of the bed is moved in an upright position and helps the patient to maintain his position on the fowler (hospital) bed.

This sliding back is useful for the aged, permanently or temporary disabled, spastic, paralyzed or patients whose movements are restricted for some other reason. The sliding back is useful in hospitals, to private nurses, and the family members who nurse a bed-ridden patient.

The bed according to the present application may have various modes of application, for example:

1. Simple bed
2. Chair
3. Bed or chair with commode
4. Lifting up of patient off the bed approximately 4-6 inches for the purpose of airing and changing bed and bed sheet 1. Simple Bed:

In normal condition where all frames (a, b, c, d) are horizontally laid, the bed works as a simple bed. This is shown in FIG. 1.

2. Chair:

When the frame (a) is held in upright position with the help of turning threaded rod (1) and frames (c, d) goes down, the bed works as a complete chair. This position is shown in FIG. 2(*b*).

3. Bed or Chair with Commode:

We have already seen how the bed works as bed or chair. Now we will see its working as commode. The commode is provided with cushion (p) which is placed between commode (g) and middle frame (b). When linkage (o) is pulled back, the pan or pot is lowered from the bed from linkage side. The pot (g) is lowered along with cushion padding (p). The cushion padding can be separated from the pan/pot, when the pan/pot is to be used. By pushing the control linkage (o), the pan/pot (g) gets shifted back to its position and is now ready for use. Different operating conditions and positions of the commode are shown in FIGS. 5(*a*) to 5(*c*).

4. Lifting Up of Patient Off the Bed Approximately 4-6 Inches for the Purpose of Airing and Changing Bed and Bed Sheet:

When one wants to lift up the patient off the bed, he/she has to pump the hydraulic telescope (i). The telescope (i) extends in height, lifting central arm of the bar (h) upwards. This is shown in FIG. 3(*b*). The bar turns around and the arms of the bar are turned downwards. This in effect pulls the straps/nets (e) over the side guards (f) and the straps/nets (e) in effect lift the person off the bed for the purpose of airing and changing bed. This particular situation is shown in FIGS. 3(*b*) and 4(*b*).

The bed according to the present embodiments displays the following advantages:

1. A bedridden person can be lifted off the bed about 4-6 inches on straps or nets and can be kept in that position for long time so as to avoid constant bed contact and airing can be done around his body.
2. Also this uplifted position allows a very easy change of bed or bed sheet.
3. The lifting and lowering arrangement makes it very easy to put bedpan under the person.
4. The bed of the present invention has number of frames which can change angles to form a complete chair position. These frames can also change angles to form an easy chair position for comfort.
5. The bed of the present invention has a built in commode.
6. This eliminates manual labor or lifting of a patient.
7. This eliminates the risk of the patient slipping and falling down.
8. The patient is prevented from being pushed forward every time the back of the bed is moved in an upright position.
9. Thus the patient maintains his position on the bed and does not have to be pulled up every time.
10. This saves a lot of trouble for the nurse/family members and a lot of pain for the patient.

The bed of the present invention enables the patient to be lifted off the bed approximately 4-6 inches for the purpose of airing, change of bed and sponging the patient. This bed is useful for the aged, permanently or temporary disabled, spastic, paralyzed or patients whose movements are restricted for some other reason. This bed is useful in hospitals, to private nurses and the family members who nurse a bed-ridden patient. It makes their job easy, safe, and stress-free.

The present invention is not limited to the above described embodiments, and various changes may be made, if desired, without departing from the essence or spirit of the invention which can be read from the claims and the entire specification. All these changes are also intended to be within technical scope of the present invention.

I claim:

1. A bed and chair with commode for a patient comprises: a rectangular main frame which stands on at least four legs; four frames being fitted on said main frame, out of said four frames an uppermost frame and two lower frames, one of the lower frames being lower than the other, are movably fitted on said main frame and a middle frame to permanently fixed to the main frame, the uppermost movable frame supports a patient's upper body and head portion, the two lower movable frames support a leg portion of the patient, and the middle frame supports the hip portion of the patient, and one of the other frames is fitted on top of the lowermost frame; at least seven straps or nets across the bed and chair width for accommodating the patient's body over the straps or nets when the patient is lifted up off the bed and chair, said straps or nets at one end fixed to the main frame and at another end connected to arms of a turnable bar, said bar is connected between two of the four legs supporting the longer side of the main frame, said bar with arms is capable of turning around; side guards being fixed on both sides of said main frame for supporting the straps or nets over it and for preventing the patient from falling down; lifting means for lifting the body of the patient over the straps or nets, when the patient is to be lifted up off the bed said lifting means lifts a central arm of the turnable bar so that when the bar is turned downwards it pulls the straps or nets over side guards and lifts up the patient off the bed and chair; and a commode pan or pot being fitted under the middle frame with the help of a hinge and linkage arrangement, the position of the commode pan or pot is controlled by said hinge and linkage arrangement, said commode pan or pot is provided with a cushion which is placed between said commode pan or pot and the middle frame.

2. A bed and chair with commode for a patient as claimed in claim 1, wherein said, uppermost middle and lower frames are associated with turning threaded rods for controlling the movement of said frames.

3. A bed and chair with commode for a patient as claimed in claim 1 wherein, uppermost frame can be tilted at different angles ranging from head low, sleeping position, to a sitting upright position with the use of a turning threaded rod.

4. A bed and chair with commode for a patient as claimed in claim 1 wherein the lower frames can be tilted at different angles ranging from a sleeping position with legs straight to a sitting position in which the legs are at right angles with the use of a turning threaded rod.

5. A bed and chair with commode for a patient as claimed in claim 1 wherein one of the frames on top of the lowermost frame folds into three pieces.

6. A bed and chair with commode for a patient as claimed in claim 1 wherein the number of arms on the turnable bar is equal to the number of straps or nets.

7. A bed and chair with commode for a patient as claimed in claim 1 wherein the lifting means is hydro mechanically operated.

8. A bed and chair with commode for a patient as claimed in claim 7 wherein said hydro mechanically operated lifting means consists of a hydraulic telescope with a handle.

9. A bed and chair with commode for a patient as claimed in claim 1 wherein the lifting means is electrically operated with an electric motor.

10. A bed and chair with commode for a patient as claimed in claim 1 wherein the lifting means is hydraulically operated with a hydraulic pump.

11. A bed and chair with commode for a patient as claimed in claim 1 wherein the lifting means is pneumatically operated with pneumatic pressure.

* * * * *